US010550599B2

(12) United States Patent
Blumhagen

(10) Patent No.: US 10,550,599 B2
(45) Date of Patent: Feb. 4, 2020

(54) PORTABLE RESIDENTIAL FENCE SYSTEM

(71) Applicant: Mark Conrod Blumhagen, Spokane Valley, WA (US)

(72) Inventor: Mark Conrod Blumhagen, Spokane Valley, WA (US)

( * ) Notice: Subject to any disclaimer, the term of this patent is extended or adjusted under 35 U.S.C. 154(b) by 149 days.

(21) Appl. No.: 15/732,142

(22) Filed: Sep. 25, 2017

(65) Prior Publication Data

US 2019/0093386 A1 Mar. 28, 2019

(51) Int. Cl.
*E04H 17/14* (2006.01)
*E04H 17/22* (2006.01)

(52) U.S. Cl.
CPC ..... *E04H 17/1421* (2013.01); *E04H 17/22* (2013.01); *E04H 2017/1473* (2013.01)

(58) Field of Classification Search
CPC ..... E04H 17/1421; E04H 17/22; E04H 2017/1473; E04H 12/223; E04H 12/22; E04H 12/2253; E04H 12/2261; E04H 12/2269
USPC ..... 256/64, 65.03, 65.14
See application file for complete search history.

(56) References Cited

U.S. PATENT DOCUMENTS 1,486,594 A * 3/1924 Malome ..... E04H 12/2292 248/511
1,722,352 A * 7/1929 Rawley ..... E04H 12/2253 52/152
2,849,202 A * 8/1958 Mccombs ..... E04H 12/2238 248/173
3,514,911 A * 6/1970 Preradovich ..... E04H 12/2261 52/165
3,809,346 A * 5/1974 Jackson ..... E04H 12/223 248/156
4,526,348 A * 7/1985 Cammack ..... E04H 17/1413 256/65.06
5,104,074 A * 4/1992 Malloy ..... E04H 12/2215 156/63
5,192,055 A * 3/1993 Griggs ..... E04H 17/22 248/354.1
6,802,496 B1 * 10/2004 Preta ..... E04H 17/1413 16/253
7,823,348 B1 * 11/2010 Leiva ..... E04G 21/185 52/170

(Continued)

FOREIGN PATENT DOCUMENTS

DE 4116738 A1 * 11/1992 ..... E04G 21/1833

*Primary Examiner* — Joshua T Kennedy
(74) *Attorney, Agent, or Firm* — Sandy Lipkin

(57) ABSTRACT

A portable residential fence system with a lower post surround assembly, a middle post surround assembly and an upper post surround assembly. Each assembly is made of four adjoining strips. The lower and middle surround assemblies are attached to each other by angled joining strips. The lower post strips include extension brackets that are flat to the ground. The lower and upper surround strips include apertures that allow bolts to extend horizontally to attach fencing to the post. Stakes can be driven through apertures in the lower assembly extension brackets and into the ground so that a fence post can be held in an upright position without the need for cement footings or other holding methods that are not portable. The surround strips and joining strips are all made of rigid material such as metal or glass filled plastic.

4 Claims, 4 Drawing Sheets

(56) References Cited

U.S. PATENT DOCUMENTS

2006/0278800 A1* 12/2006 Simmons ..... E04H 12/2238
248/511
2007/0034846 A1* 2/2007 Ratanasiriwilai ... E04H 17/1413
256/65.01

* cited by examiner

PORTABLE RESIDENTIAL FENCE SYSTEM

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of fencing systems and more specifically to portable residential fence system.

Fences of various types are used to separate properties and to help enclose a property to create privacy or to prevent pets from escaping the property.

In most cases, fence posts need to be set in the ground via cement footings or other methods that require relatively permanent displacement of dirt in the vicinity of the fence post.

Although this method of setting fence post and associated fencing is effective, it is not suitable for instances where the fencing may be moved at some future date and where the resulting move would leave the ground around the fence posts severely disrupted due to the pulling out of cement footings or deep holes created from installing standard fence posts deep into the ground.

BRIEF SUMMARY OF THE INVENTION

The primary object of the invention is to provide a portable fence system that allows a person to secure a fence in an upright position without needing to dig post holes or use cement for fastening posts into the ground.

Another object of the invention is to provide a portable fence system that allows the user to adjust the angle of the fence panels as well as the length of each fence section.

Another object of the invention is to provide a portable fence system that allows fencing to be easily attached to fence posts.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a portable residential fence system comprising: a lower post surround assembly, a middle post surround assembly, an upper post surround assembly, a plurality of lower to middle post joining strips, a long lower post extension bracket, a short lower post extension bracket, a plurality of post to fence connection bolts, a plurality of surround assembly connection nuts and bolts, a plurality of ground stakes, said upper, said middle and said lower post surround assemblies each made up of four strips, each said surround strip having forty-five degree flanges at each end, said lower to middle post joining strips each joining said lower surround assembly to said upper surround assembly, said upper post surround strips having apertures capable of receiving said fence connection bolts, all said strips and said extension brackets being made of rigid material such as metal or glass reinforced plastic, said ground stakes capable of penetrating apertures in said long and short extension brackets, and said ground stakes capable of being driven into dirt to allow said fence post and attached fence to remain in an upright position without the benefit of additional bracing or cement footings.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
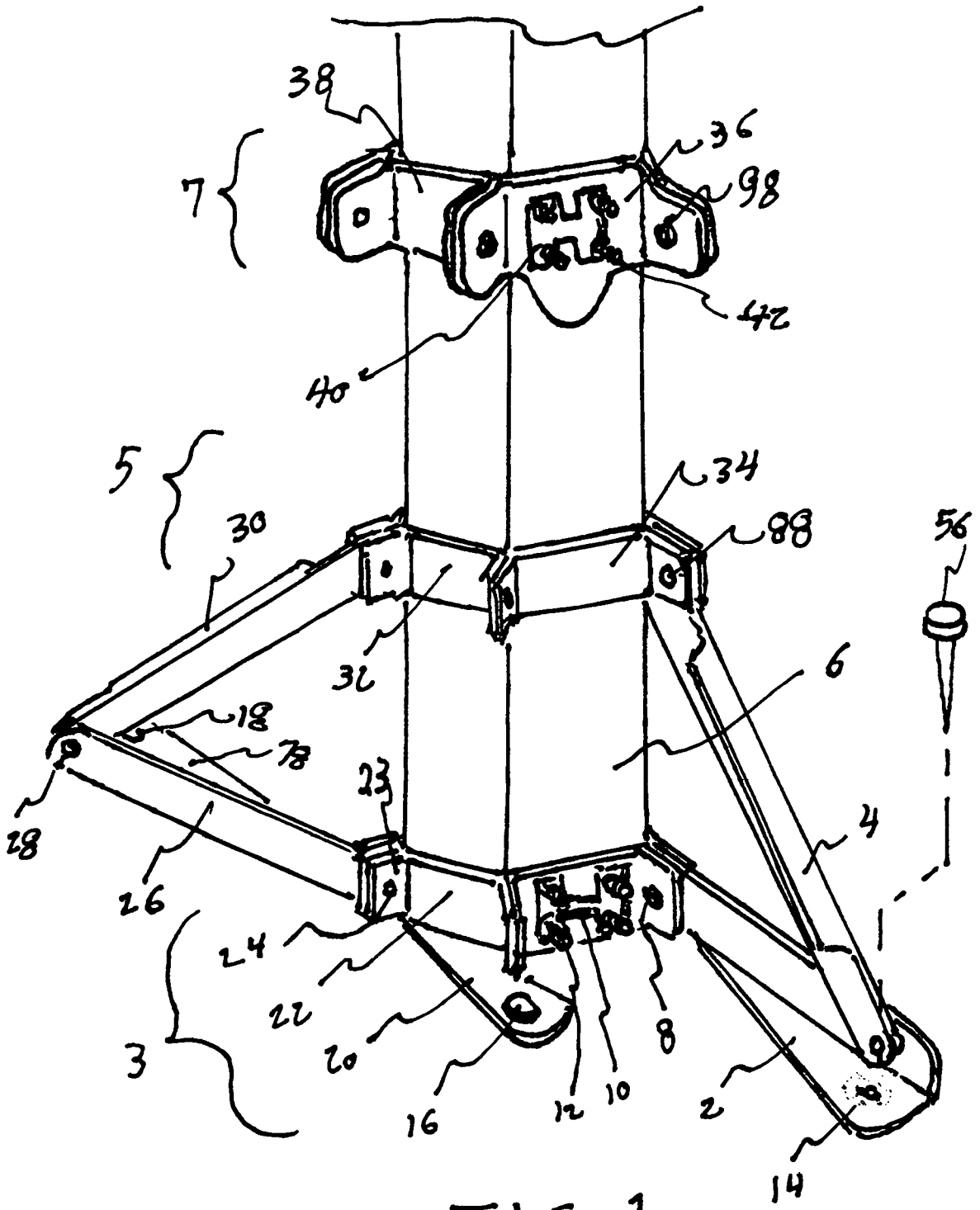
FIG. 1 is a perspective view of the invention.

Referring now to FIG. 1 we see a perspective view of the invention. A typical fence post 6 is being supported by a lower surround assembly 3, a middle surround assembly 5 and an upper surround assembly 7. The surround assemblies 3, 5, 7 are each comprised of four horizontal rigid strips 22, 32, 34, 36, 38. Some strips 22 include apertures 10 that allow bolts 12 with shallow heads to be trapped between the strip and the fence post 6 so that the bolts 12 protrude out horizontally to allow a fence section to be attached. Each strip 22 terminates at each end in a forty-five-degree angled tab 23. Each tab 23 includes an aperture 24 to allow the strips 22 to be attached to each other by nuts and bolts 24, 28, 88, 98 as they surround the post 6. Strip 22 includes an integral plate 20 or 2 that is horizontally disposed and in intimate connection with the ground plane. The strips 22 can either have long plates 2, or short plates 20 depending on the conditions of the area in which the fence is to be placed. Stakes 56 are driven into apertures 14, 18 at the ends of each plate 2, 20, 78. Angled support brackets 4, 30 connect the lower surround assembly 3 with the upper surround assembly 5 and produce a structural rigidity that helps hold the post 6 in a vertical position, without the need for ground disturbing cement footers, or deep holes that might be needed to sink posts 6 sufficiently into the earth to be stable. In this way, the fence system of the present invention allows the user to remove the fence when needed without seriously disturbing the ground upon which the fence posts have been placed.

Figure 2:
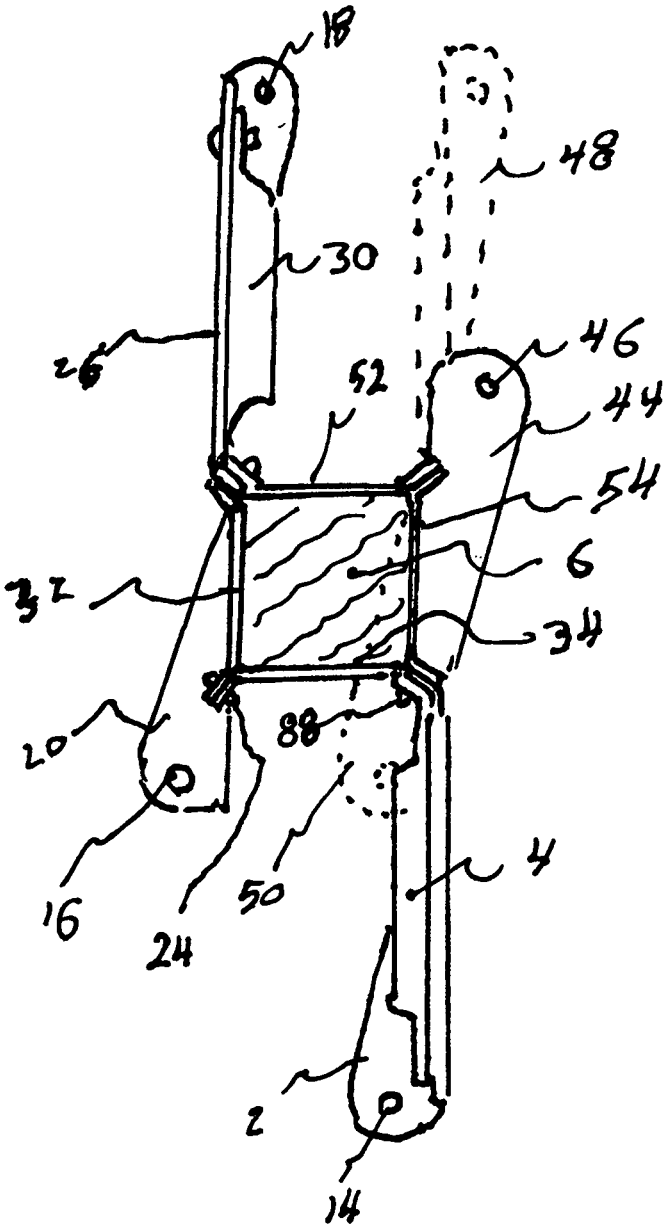
FIG. 2 is a top view of the invention.

FIG. 2 is a top view of the invention where post 6 is terminated just above middle surround assembly 3. This view clearly shows long integral plate 2 and short integral plate 20. The plates 2, 20 can be exchanged for one another as shown in dotted line drawings 48, 50 if the closeness of a nearby object, such as a wall requires it. The attachment of the plates 2, 30, 44, 20 to the ground via stakes 56 that penetrate apertures 14, 18, 46, 16 cause the entire fence post assembly to hold fence post 6 securely in a vertical position. All strips and brackets and plates are made of rigid material such as metal or glass filled plastic and are made weatherproof by standard coatings or by the nature of the material used.

Figure 3:
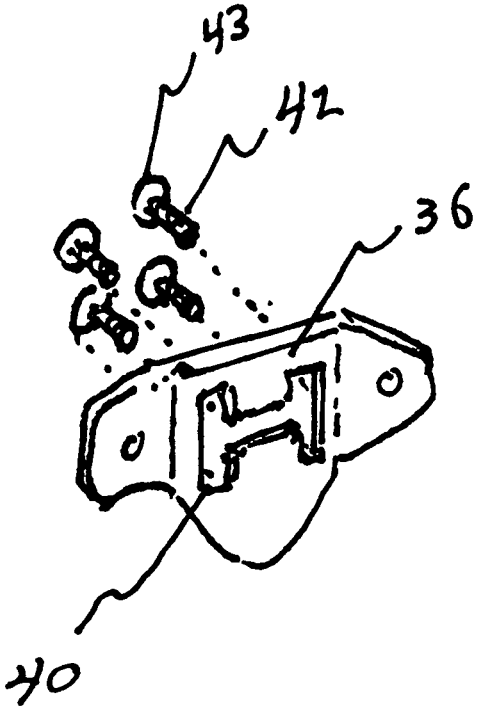
FIG. 3 is a perspective view of the fence attachment bracket portion of the invention.

FIG. 3 is an enlarge perspective view of middle strip 36. The aperture 40 is in an "H" shape but can also be in other shapes that are designed to capture the thin flat head 43 of bolt 42 so that the head 43 can be trapped between the plate 36 and the surface of the fence post 6. The bolts 42 are used for fastening standard fencing to the post 6.

Figure 4:
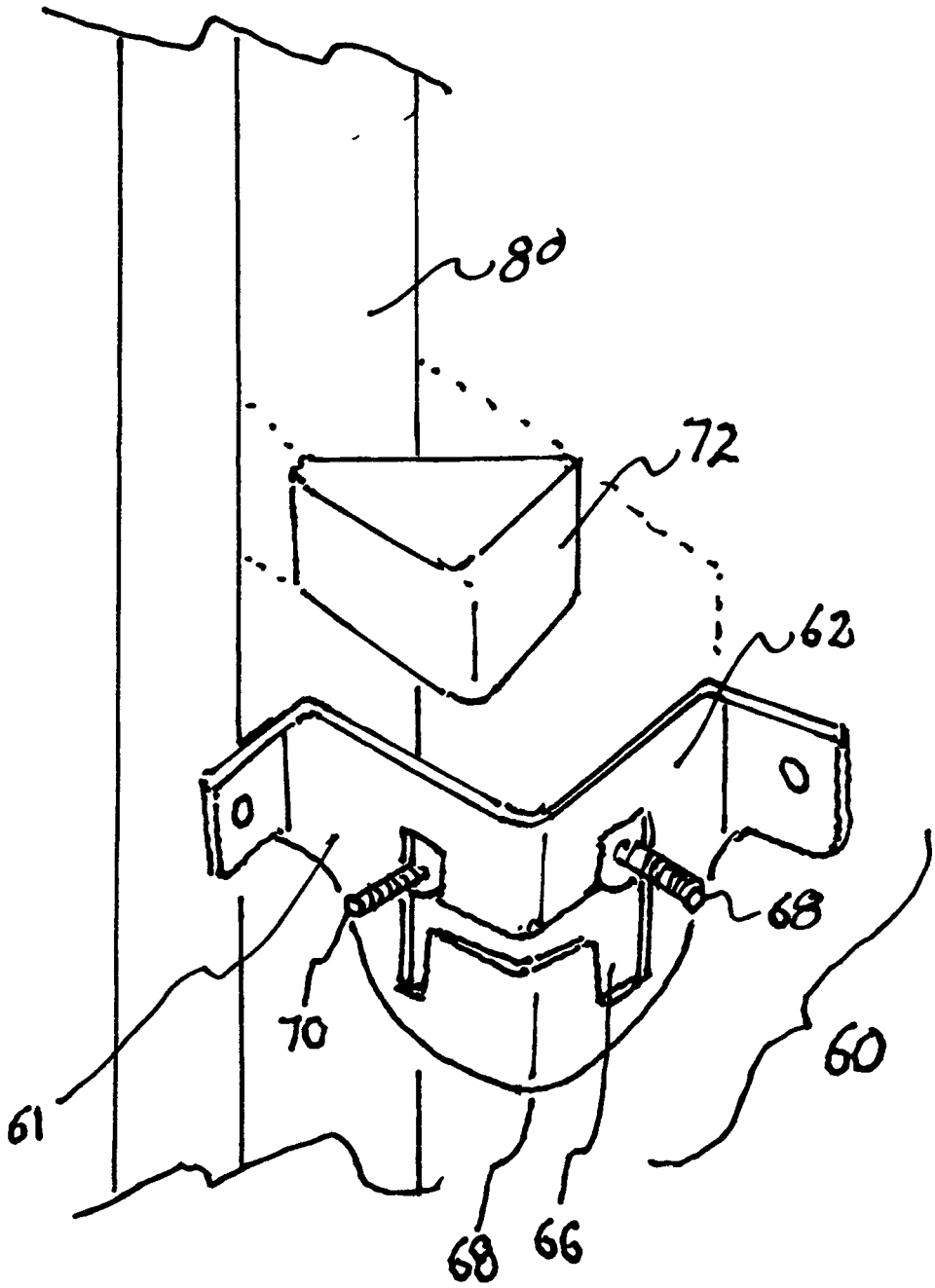
FIG. 4 is a perspective view of an alternate middle strip bracket.

FIG. 4 is a perspective view of an alternate middle strip bracket 60 which includes a central angle or bend 68 creating two planes 61, 62 that allows the bolts 70 to protrude out at alternate angles in case the fence does not proceed in a straight line, but rather at an angle. Backstop 72 is made of rigid material such as injection molded plastic and fills the space between post 80 and bracket 60 so that the heads of bolts 70 are securely trapped between the bracket panels 61, 62 and the backstop 72.

In the above described and illustrated way, the present invention provides a unique method for the construction of a fence without needing to dig deep holes in the ground prior to construction. This allows the fence and fence posts to be easily dis-assembled when necessary and leaves the surrounding environment in a relatively undisturbed condition.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A portable residential fence system comprising:

at least one fence post to be attached to one or more other fence posts thereby creating a fence, each of said fence posts having four faces, each of said four faces being situated at a 90 degree angle from each adjacent face thereby forming a substantially rectangular cross-section;

a lower post surround assembly further comprising four plates to abut against each of said four faces on said fence post, each of said four plates terminating in a flange that extends at an angle outward therefrom, each of said flanges having an aperture therethrough such that each of said adjacent four faces can be affixed to each other through securing each flange to each adjacent flange with hardware placed inside of each aperture;

a middle post surround assembly further comprising four plates to abut against each of said four faces on said fence post, each of said four plates terminating in a flange that extends at an angle outward therefrom, each of said flanges having an aperture therethrough such that each of said adjacent four faces can be affixed to each other through securing each flange to each adjacent flange with hardware placed inside of each aperture;

an upper post surround assembly further comprising four plates to abut against each of said four faces on said fence post, each of said four plates terminating in a flange that extends at an angle outward therefrom, each of said flanges having an aperture therethrough such that each of said adjacent four faces can be affixed to each other through securing each flange to each adjacent flange with hardware placed inside of each aperture;

a first extension bracket extending from said lower post surround assembly with an aperture therethrough;

a second extension bracket extending from said lower post surround assembly with an aperture therethrough;

at least one post to fence connection bolt extending outwardly from at least one plate of both the lower and upper post surround assemblies to facilitate connection to a fence;

a plurality of ground stakes;

wherein said lower post surround assembly is connected to said middle post surround assembly through connecting members;

all said plates and said extension brackets being made of rigid material;

wherein said ground stakes are capable of penetrating said apertures in said first and second extension brackets; and wherein said ground stakes are capable of being driven into dirt to allow said fence post and attached fence created by said fence system to remain in an upright position without the benefit of additional bracing and cement footings.

2. A portable residential fence system as claimed in claim 1 wherein said first and second extension brackets have either a long length or a short length and can be used interchangeably depending on the position of the fence post in relation to nearby objects such as walls.

3. A portable residential fence system as defined in claim 1 wherein said rigid material is metal.

4. A portable residential fence system as defined in claim 1 wherein said rigid material is glass reinforced plastic.

* * * * *